US006419113B1

(12) United States Patent
Tramontina

(10) Patent No.: US 6,419,113 B1
(45) Date of Patent: Jul. 16, 2002

(54) CARTRIDGE FOR DISPENSING PAPER PRODUCTS

(75) Inventor: Paul F. Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 08/991,669

(22) Filed: Dec. 16, 1997

(51) Int. Cl.[7] ..... A47K 10/24; B65H 1/00
(52) U.S. Cl. ..... 221/45; 221/46; 221/63
(58) Field of Search ..... 221/34, 63, 45, 221/46, 47; 206/738, 748, 772

(56) References Cited

U.S. PATENT DOCUMENTS

| | | | |
|---|---|---|---|
| 371,473 | A | 10/1887 | Onderdonk |
| 813,594 | A | 2/1906 | Sexton |
| 1,170,380 | A | 2/1916 | Winter |
| 1,579,429 | A | 4/1926 | Arms |
| 1,605,231 | A | 11/1926 | Hoberg |
| 1,665,057 | A | 4/1928 | Genest |
| 1,709,214 | A | 4/1929 | Griffith et al. |
| D92,455 | S | 6/1934 | Coles |
| 1,974,926 | A | 9/1934 | Marsh |
| 1,989,381 | A | 1/1935 | Samson |
| 2,033,582 | A | 3/1936 | Materno |

(List continued on next page.)

FOREIGN PATENT DOCUMENTS

| | | |
|---|---|---|
| DE | 1289274 | 2/1969 |
| EP | 331027 A1 | 2/1989 |
| EP | 0372781 A1 | 6/1990 |

(List continued on next page.)

OTHER PUBLICATIONS

PCT Search Report, International Application No. PCT/US98/26702, dated Mar. 31, 1999.

Abstract of France Patent No. 2362610.

Abstract of Japan Patent No. 187873.

English Translation of Taiwanese Patent Publication No. 195789, entitled "Auto–Dispensing Tissue Container," Application Date Jul. 18, 1992, Application No. 81209554.

General Catalogue '93 (in both Spanish and English), Lineacqualba.

(List continued on next page.)

*Primary Examiner*—Joseph E. Valenza
*Assistant Examiner*—Gene O. Crawford
(74) *Attorney, Agent, or Firm*—Dority-Manning, P.A.

(57) ABSTRACT

A cartridge is disclosed for holding and dispensing a plurality of paper products in a dispensing direction, the cartridge being insertable into an interior area of a container having a housing defining a plurality of exterior walls and a dispensing throat, the interior area being disposed within an interior surface defined by the plurality of exterior walls, at least one protrusion extending from the interior surface into the interior area. The cartridge includes a cartridge body including a plurality of cartridge side walls and an end defining a dispensing opening configured to guide paper products in the dispensing direction through the dispensing throat. At least one opening is defined in at least one of the side walls of the cartridge body extending through the at least one of the cartridge side walls. The opening is located within the cartridge body so that when the cartridge is placed in the interior area of the housing the protrusion extends through the opening to contact edges of the plurality of paper products to oppose movement of the paper products in the dispensing direction. Removable portions may be provided in the cartridge side walls that, when removed, create the opening in the cartridge side walls.

21 Claims, 7 Drawing Sheets

U.S. PATENT DOCUMENTS

| | | | | | |
|---|---|---|---|---|---|
| 2,143,614 | A | | 1/1939 | Winter et al. | |
| 2,195,437 | A | | 4/1940 | West | |
| 2,323,395 | A | | 7/1943 | Harwood | |
| 2,730,267 | A | | 1/1956 | Mercalus | |
| 2,816,376 | A | | 12/1957 | Hirvonen | |
| 2,858,016 | A | | 10/1958 | Marano | |
| 2,858,045 | A | | 10/1958 | Loeb | |
| 3,028,047 | A | * | 3/1962 | Tuft | 221/46 X |
| 3,161,336 | A | | 12/1964 | Loescher | |
| 3,164,298 | A | | 1/1965 | Pepko | |
| 3,203,586 | A | | 8/1965 | Downham | |
| 3,258,114 | A | * | 6/1966 | King | 206/738 X |
| 3,272,385 | A | | 9/1966 | Watkins | |
| 3,343,716 | A | * | 9/1967 | Peebles | 221/46 |
| 3,349,959 | A | | 10/1967 | Watkins | |
| 3,724,716 | A | | 4/1973 | Baraconi et al. | |
| 3,747,802 | A | | 7/1973 | Uroshevich | |
| 3,754,681 | A | | 8/1973 | Slye et al. | |
| 4,004,691 | A | | 1/1977 | Wihksne | |
| 4,469,243 | A | * | 9/1984 | Ito et al. | 221/63 X |
| 4,491,242 | A | | 1/1985 | Trinidad | |
| 4,566,607 | A | | 1/1986 | Smith | |
| 4,623,076 | A | | 11/1986 | Dearwester | |
| 4,678,099 | A | | 7/1987 | Matsui | |
| 4,679,703 | A | | 7/1987 | De Luca | |
| 4,706,844 | A | | 11/1987 | Omdoll et al. | |
| 4,768,679 | A | | 9/1988 | Matsui | |
| 4,805,800 | A | * | 2/1989 | Nocek et al. | 221/63 X |
| 4,838,454 | A | | 6/1989 | Salzmann et al. | |
| D302,949 | S | | 8/1989 | Eisendrath | |
| 4,877,154 | A | | 10/1989 | Matsui | |
| 5,002,200 | A | * | 3/1991 | Hunt | 221/63 X |
| 5,020,670 | A | | 6/1991 | Bedford | |
| 5,065,895 | A | | 11/1991 | De Luca et al. | |
| 5,090,592 | A | | 2/1992 | Petterson et al. | |
| 5,100,020 | A | | 3/1992 | Petterson et al. | |
| 5,102,007 | A | | 4/1992 | Petterson et al. | |
| 5,219,092 | A | | 6/1993 | Morand | |
| D347,344 | S | | 5/1994 | Schumaker | |
| 5,310,057 | A | * | 5/1994 | Caldwell et al. | 221/63 X |
| 5,332,118 | A | | 7/1994 | Muckenfuhs | |
| 5,348,004 | A | * | 9/1994 | Rizzuto | 221/63 X |
| 5,356,032 | A | | 10/1994 | Rhodes | |
| 5,460,322 | A | | 10/1995 | Carlson et al. | |
| D366,583 | S | | 1/1996 | Scaife | |
| 5,509,971 | A | | 4/1996 | Weber | |
| 5,520,308 | A | | 5/1996 | Berg, Jr. et al. | |
| 5,590,813 | A | | 1/1997 | Abramczyk et al. | |
| 5,622,281 | A | | 4/1997 | Annand | |
| 5,632,409 | A | | 5/1997 | Raghunanan | |
| 5,642,836 | A | | 7/1997 | Merriweather, Jr. | |
| 5,690,230 | A | | 11/1997 | Griffith | |
| 5,836,478 | A | | 11/1998 | Weiss | |
| 5,853,845 | A | | 12/1998 | McConnell et al. | |
| 5,931,339 | A | | 8/1999 | Dodge et al. | |
| 5,950,863 | A | * | 9/1999 | Schutz et al. | 221/46 X |

FOREIGN PATENT DOCUMENTS

| | | | |
|---|---|---|---|
| EP | 0419063 | A2 | 3/1991 |
| EP | 0811348 | A2 | 12/1997 |
| FR | 336986 | | 11/1903 |
| FR | 1537127 | | 7/1968 |
| FR | 2362610 | | 3/1978 |
| GB | 423276 | | 1/1935 |
| GB | 1112680 | | 5/1968 |
| JP | 1878873 | | 8/1991 |
| SE | 149028 | | 3/1955 |
| TW | 195789 | | 7/1981 |
| WO | 9709918 | | 8/1996 |
| WO | 9840002 | | 1/1998 |
| WO | WO9930601 | | 6/1999 |

OTHER PUBLICATIONS

Marplas Catalog, (in both Spanish and English), Lineacqualba.

CEMASA Comercial Catalog (Italian), Jun. 30, 1999.

English Translation of CEMASA Comercial Catalog, Jun. 30, 1999.

* cited by examiner

CARTRIDGE FOR DISPENSING PAPER PRODUCTS

BACKGROUND OF THE INVENTION

This invention relates generally to the field of dispensing devices and systems. More particularly, this invention relates to the field of devices and systems for dispensing paper products such as napkins, towels, toilet tissue, etc.

Various types of dispensers for paper products have been developed to provide ready availability of the paper products to users. Such dispensers are often provided in public places such as restaurants or rest rooms where customers remove from the dispenser a desired amount of paper products for personal use. In some high traffic areas, such as fast food restaurants, a large number of customers may use a paper product dispenser such as a napkin dispenser in a short period of time. Therefore, dispensers have been developed that hold a large number of paper products for use by a large number of consumers.

Unfortunately, large dispensers are subject to a number of drawbacks. First, it is difficult to uniformly dispense individual paper products from a large dispenser without dispensing more paper products than necessary to a user. Thus, too many paper products are removed by a user, and some of the paper products are wasted. If too many paper products are removed from a dispenser, the benefits provided by a larger dispenser are eliminated as the dispenser is emptied more rapidly.

Second, many dispensers are difficult to load, and that difficulty can increase with the size of the dispenser. If paper products are not properly loaded into the dispenser, the paper products may jam as they are removed thereby preventing further removal of paper products by users. Also, a person refilling a large dispenser is more likely, due to the larger number of paper products involved, to drop some of the paper products onto a floor. Any dropped paper products are then unsanitary and must be discarded, thereby creating more waste and again defeating the benefits of the larger dispenser.

A further drawback of many currently available dispensers regardless of size is that it is impossible to determine without opening the dispenser how many paper products remain within the dispenser. Thus, a person must either periodically check the dispenser to determine how many paper products remain or be vigilant to refill the dispenser as soon as it is empty. Both alternatives involve much personal attention and, especially during peak usage, can lead to empty dispensers if dispensers are not vigilantly monitored.

OBJECTS AND SUMMARY OF THE INVENTION

It is a principle object of the present invention to provide an improved container and cartridge for dispensing paper products that can be readily adapted to various applications.

Another object of the present invention is to provide a container and cartridge for dispensing paper products that are simple and inexpensive to manufacture, and that are reliable in use.

Still another object of the present invention is to provide a container and cartridge for dispensing paper products that provide metered delivery of individual paper products.

Yet another object of the present invention is to provide a container and cartridge for dispensing paper products that reduce the incidence of waste of the paper products, either due to dispensing too many paper products to a user or due to dropping of the paper products during refilling of the container.

Still another object of the present invention is to provide a container and cartridge for dispensing paper products that provide an indication of the remaining amount of the paper products ready for dispensing to users.

Yet another object of the present invention is to provide a container and cartridge for dispensing paper products that reduce the incidence of jamming of paper products and the resultant inability to dispense further paper products.

Still another object of the present invention is to provide a container and cartridge for dispensing paper products that supports the weight of paper products so that individual paper products are readily removed.

To achieve these objects and in accordance with the purposes of the invention, as embodied and broadly described herein, a container for dispensing individual paper products is provided, the container including a housing including a plurality of exterior walls defining an interior surface and an interior area within the interior surface for receiving a plurality of the paper products. A first of the exterior walls defines a dispensing throat for permitting removal of paper products from the interior area. A mechanism urges paper products within the interior area toward the dispensing throat in a dispensing direction. A second and third of the exterior walls intersect the first exterior wall on opposite sides of the first exterior wall and form a portion of the interior surface. Protrusions extend from the portion of the interior surface on the second and third exterior walls into the interior area for contacting the paper products to oppose the means for urging. The protrusions on the second wall are staggered from the protrusions on the third wall in the dispensing direction.

The urging mechanism may include a spring-loaded plate disposed in the interior area of the housing for urging the paper products in the dispensing direction, and the dispensing direction may be substantially horizontal. Alternately, the mechanism for urging may include an attachment portion of the housing for attaching the housing to a substantially nonhorizontal surface, the paper products being urged in the dispensing direction by gravity, and the dispensing direction may be substantially vertical.

Preferably, the protrusions include curved bumpers, and, more preferably, the curved bumpers include a plurality of ridges extending across the curved bumpers perpendicular to the dispensing direction.

Preferably, the housing further includes a staging area proximate the dispensing throat for spacing and slowing the paper products, the staging area including at least one rib member extending parallel to the dispensing direction and a number of teeth extending from the rib member for contacting the paper products and opposing the mechanism for urging.

A given one of the exterior walls is preferably a door hingedly attached to the housing, the door being openable for insertion of the plurality of paper products into the interior area.

Optionally, a cartridge may be provided for insertion into the interior area of housing for containing the plurality of paper products, and the cartridge preferably includes removable portions, removal of the removable portions creating openings in the cartridge. At least one of the openings in the cartridge is preferably disposed adjacent at least one of the protrusions so that the protrusion extends through the opening to contact the plurality of paper products. At least one rib member is preferably provided in the interior area of the housing proximate the dispensing throat, the rib member including teeth extending from the rib member, at least one of the openings in the cartridge being disposed adjacent at least one of the rib members so that the teeth extend through the opening to contact the plurality of paper products.

In accordance with another aspect of the invention, a container for dispensing individual paper products is provided, the container including a housing including a plurality of exterior walls defining an interior surface and an interior area within the interior surface for receiving a plurality of the paper products. A first of the exterior walls defines a dispensing throat for permitting removal of paper products from the interior area. A mechanism urges paper products within the interior area toward the dispensing throat in a dispensing direction. At least one protrusion extends from the interior surface into the interior area of the housing. A cartridge is provided for insertion into the interior area of the housing for containing the plurality of paper products, the cartridge including at least one removable portion, removal of the removable portion creating an opening in the cartridge. The opening in the cartridge is disposed adjacent the protrusion so that the protrusion extends through the opening to contact the plurality of paper products to oppose the means for urging when the cartridge is placed in the interior area of the housing.

Preferably, the cartridge includes a second removable portion, removal of the second removable portion creating a second opening in the cartridge, and wherein the mechanism for urging includes a spring-loaded plate disposed in the interior area of the housing and extending through the second opening for urging the paper products in the dispensing direction, the dispensing direction being preferably substantially horizontal. Alternately, the mechanism for urging includes an attachment portion of the housing for attaching the housing to a substantially nonhorizontal surface, the paper products being urged in the dispensing direction by gravity, the dispensing direction preferably being substantially vertical.

Preferably, a second and third of the exterior walls intersect the first exterior wall on opposite sides of the first exterior wall, the at least one protrusion including a plurality of protrusions extending from the second and third exterior walls into the interior area, the protrusions including curved bumpers, the curved bumpers preferably including a plurality of ridges extending across the curved bumpers perpendicular to the dispensing direction.

Preferably, a staging area is provided proximate the dispensing throat for spacing and slowing the paper products, the staging area preferably including at least one protrusion, the protrusion including a rib member extending parallel to the dispensing direction and a number of teeth extending from the rib member for contacting the paper products and opposing the means for urging.

In accordance with another aspect of the invention, a container for dispensing individual paper products is provided, the container including a housing including a plurality of exterior walls defining an interior area for receiving a plurality of the paper products. A first of the exterior walls defines a dispensing throat for permitting removal of paper products from the interior area. A mechanism urges paper products within the interior area toward the dispensing throat in a dispensing direction. A second and third of the exterior walls intersect the first exterior wall on opposite sides of the first exterior wall. A first group of protrusions extends from the second and third exterior walls into the interior area. A fourth of the exterior walls is a door hingedly attached to the housing, the door being openable for insertion of the plurality of paper products into the interior area. A fifth of the exterior walls is disposed opposite the fourth exterior wall. A second group of protrusions extends from the first wall and the fifth wall into the interior area. The first and second groups of protrusions contact the paper products to oppose the mechanism for urging.

Preferably, the first group of protrusions includes curved bumpers, which preferably include a plurality of ridges extending across the curved bumpers perpendicular to the dispensing direction. Preferably, the second group of protrusions includes ribs disposed in a staging area proximate the dispensing throat for spacing and slowing the paper products.

In accordance with another aspect of the invention, a cartridge for holding and dispensing a plurality of paper products is provided, the cartridge being insertable into an interior area of a container having a housing, the interior area being disposed within an interior surface defined by a plurality of exterior walls, at least one protrusion extending from the interior surface into the interior area, the cartridge including a cartridge body including cartridge walls, and at least one removable portion defined in the cartridge body, removal of the removable portion creating an opening through at least one of the cartridge walls, the removable portion being located on the cartridge body so that when the cartridge is placed in the interior area of the housing the protrusion extends through the opening to contact the plurality of paper products.

Preferably, the cartridge walls include two opposing walls and at least two removable portions are provided, each removable portion being disposed on one of the cartridge opposing walls. More preferably, the cartridge walls include four cartridge side walls and at least four removable portions are provided, each removable portion being disposed on one of the cartridge side walls.

The cartridge preferably defines at least one slot through one of the cartridge walls, the slot being visible from outside the housing when the cartridge is in the interior area of the housing, an amount of paper products disposed within the cartridge being determinable by visually inspecting the amount of paper products through the slot.

Additional objects and advantages of the invention will be set forth in part in the following description, or may be obvious from the description, or may be learned through the practice of the invention.

BRIEF DESCRIPTION OF THE DRAWINGS

The present invention will be more fully understood from the following detailed description, taken in conjunction with the accompanying drawings, wherein like reference numerals refer to like parts, and in which.

DETAILED DESCRIPTION OF THE PREFERRED EMBODIMENTS

Figure 1:
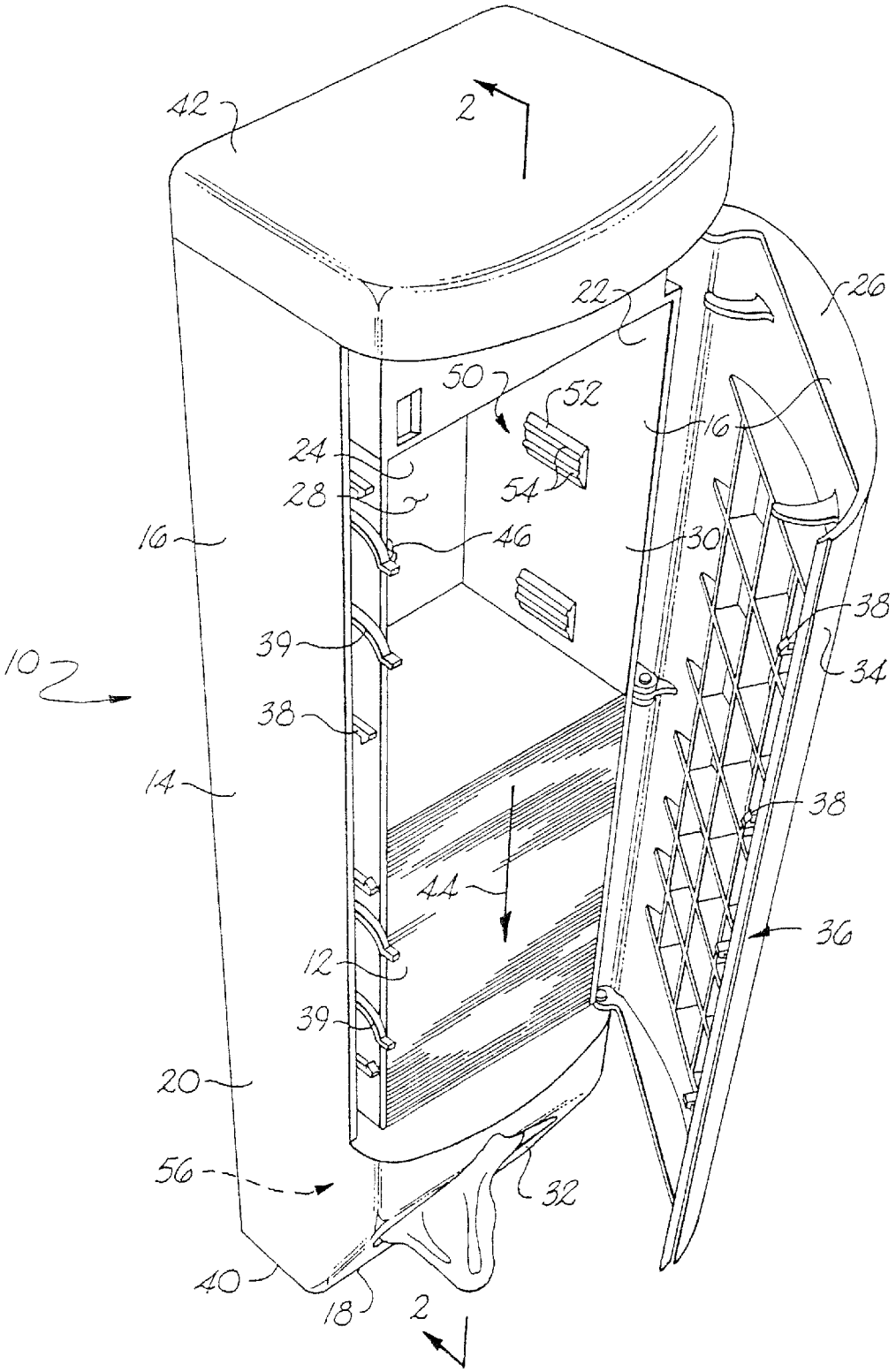
FIG. 1 is a perspective view of a container for dispensing paper products according to a first embodiment of the invention.

Reference will now be made in detail to the presently preferred embodiments of the invention, one or more examples of which are illustrated in the drawings. Each example is provided by way of explanation of the invention and not meant as a limitation of the invention. For example, features illustrated or described as part of one embodiment or figure can be used on another embodiment or figure to yield yet another embodiment. It is intended that the present invention include such modifications and variations.

As broadly embodied in FIGS. 1–5, a first embodiment of container 10 is disclosed for dispensing paper products 12. Container 10 includes a housing 14 in which paper products 12 are placed and from which paper products 12 are dispensed. Paper products 12 may be paper napkins, paper towels, toilet tissue, or any other similar material.

Figure 2:
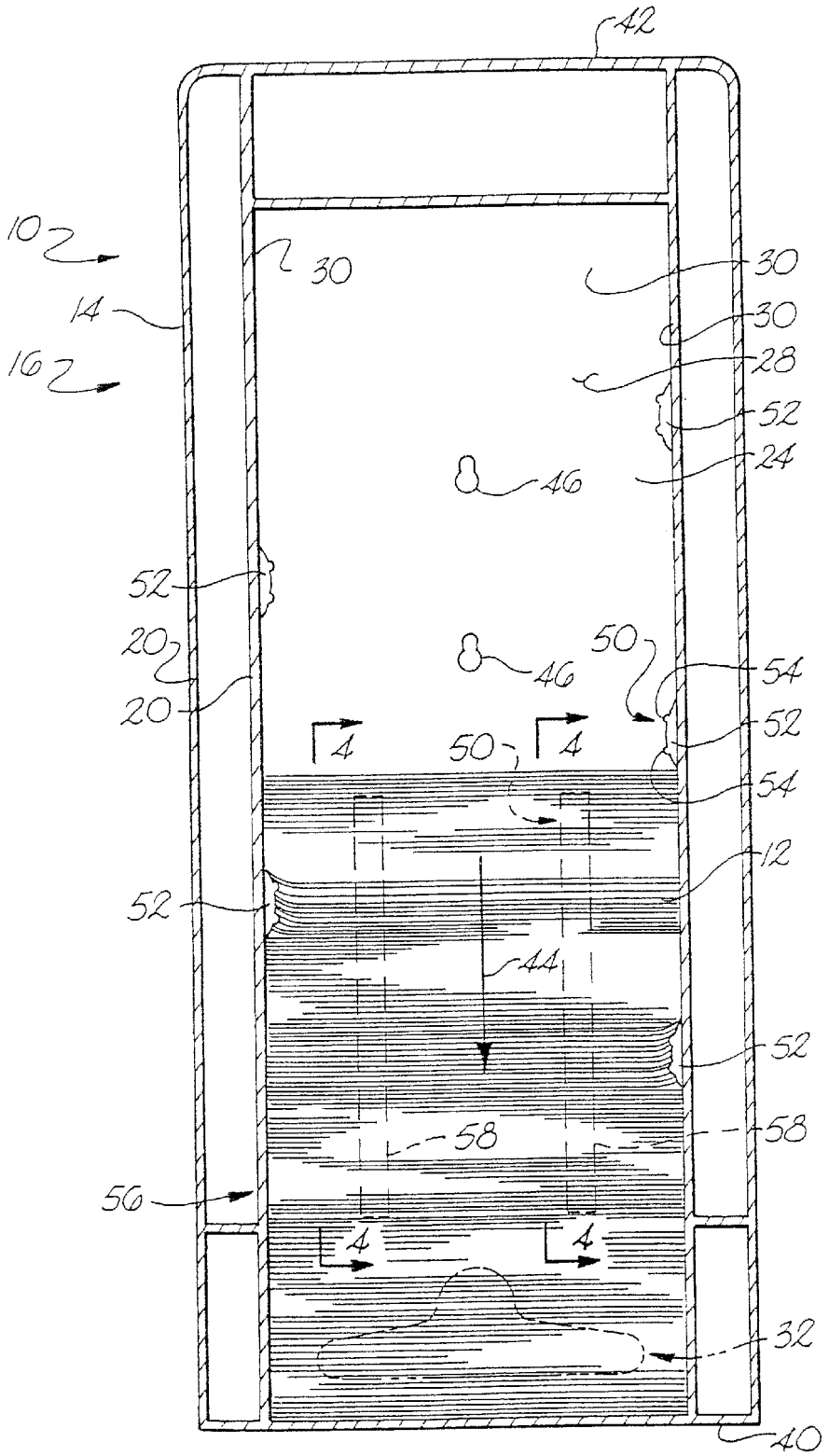
FIG. 2 is a sectional view of the container of FIG. 1 taken along line 2—2 in FIG. 1.

Housing 14 includes a number of exterior walls 16 for housing paper products 12. A first wall 18 includes a dispensing throat 32 through which paper products 12 are individually removed by a user, as will be described below. A second wall 20 and a third wall 22 intersect first wall 18 at a first end wall 40 of housing 14. Fourth wall 26 and fifth wall 24 extend between second wall 20 and third wall 22. Housing 14 also includes a second end wall 42 opposite first end 40 wall. The exterior walls 16 together define an interior surface 30 of housing 14, within which an interior area 28 is located. As shown in FIGS. 1 and 2, exterior walls 16 and end walls 40 and 42 may each, if desired, be made of two planar portions. Such construction strengthens housing 14 and is useful in locations where the housing might be vandalized. The outer portions of walls 16 help withstand any blow or impact to housing 14 to prevent its destruction or removal of the housing from its mounting or paper products from the housing.

As shown in FIG. 1, fourth wall 26 includes a door 34 hingedly attached to third wall 22. Door 34 is openable for insertion of paper products 12 into interior area 28 of housing 14 when the supply of paper products 12 runs low. Door 34 includes a latching mechanism 36 including a number of interfering notched tabs 38 on door 34 and second wall 20 that hold door 34 closed. Tabs 38 on either door 34 or second wall 20 are movable when desired to reopen door 34 by turning a key lock (not shown). The lock may be either located on door 34, in which case the tabs 38 on door 34 are movable, or on the main part of housing 14, in which case the tabs 38 on second wall 20 are movable. Leaf springs 39 may be provided to assist in reopening door 34 upon unlocking. Any other type of latching mechanism for reopenably securing door 34 may be used within the scope of the invention.

In accordance with the invention, a means is provided for urging paper products 12 within interior area 28 toward dispensing throat 32 in a dispensing direction 44. various alternatives are possible within the scope of the invention to urge paper products 12 toward dispensing throat 32 in dispensing direction 44.

For example, as shown in FIGS. 1 and 2, an attachment portion 46 of housing 14 may be provided for attaching housing 14 to a substantially nonhorizontal surface such as vertical wall 48. As shown in FIG. 2, attachment portion 46 may define holes through fifth wall 24 of housing 14 for receiving attachment members (not shown) such as screws, bolts, nails, etc. for attaching housing 14 to wall 48. Alternately, a mounting bracket could be formed on an exterior surface of fifth wall 24 for contacting and being supported by another bracket, screws, bolts, nails, etc. extending from wall 48. Further, housing 14 could be secured to wall 48 via a glue, epoxy, etc., or any other type of adhesive. Also, it would be possible to locate attachment portion 46 on any part of housing 14, such as second wall 20, third wall 22, first end 40, or second end 42, and to use combinations of mounting devices on several of the above-identified parts of housing 14. Further, housing 14 could simply be positioned such that first end 40 is lower than second end 42, and so that first end 40 and possibly fifth wall 24 are supported in some way without fixing housing 14 to any particular structure.

Thus, the means for urging paper products 14 toward dispensing throat 32 in dispensing direction 44 may comprise any structure or orientation, or both, of housing 14 and/or wall 48 that allows paper products 12 to be dispensed from dispensing throat 32 and to be urged in dispensing direction 44 by gravity. A second type of a mechanism for urging paper products 12 toward dispensing throat 32 in dispensing direction 44 will be discussed below in relation to a second embodiment (110) of container 10.

In accordance with the invention, at least one protrusion, referred to generally as 50, extends from interior surface 30 on at least one of exterior walls 16 into interior area 28 of housing 14. Preferably, as shown in FIG. 2, second wall 20 and third wall 22 include protrusions 50 extending into interior area 28. Protrusions 50 preferably comprise curved bumpers 52, which may include a plurality of ridges 54 extending across the curved bumpers perpendicular to dispensing direction 44.

As shown best in FIG. 2, bumpers 52 extend into interior area 28 to contact paper products 12 and thereby oppose the means for urging paper products 12 in dispensing direction 44. By extending into interior area 28 to contact paper products 12, bumpers 52 impede the movement of paper products 12 toward dispensing throat 32, but do not prohibit such movement. Ridges 54 allow numerous paper products 12 to be contacted by an individual bumper and allow for a smoother movement of paper products through housing 14. In embodiments where the means for urging paper products 12 in dispensing direction 44 includes mounting housing 14 so that gravity causes such movement, protrusions 50 also support paper products 12 against the force of gravity. Protrusions 50 therefore reduce the gravitational force of the bottom of the paper products 12 on dispensing throat 32, thereby making it easier for a user to remove individual paper products from dispensing throat 32.

Figure 3:
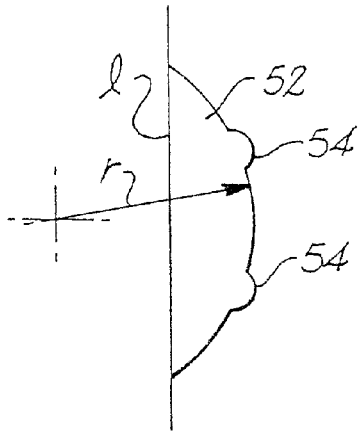
FIG. 3 is a diagrammatical view of a preferred embodiment of a curved bumper protrusion of the container shown in FIG. 2.

FIG. 3 shows a preferred profile of one of the bumpers 52. As shown, the exterior curve of bumper is defined by a radius r of from about 1.125 to 1.750 in. The bumper has a chordal length of from about 1.625 to 5 1.875 in. Two ridges 54 each have a radius of from about 0.125 to 0.250 in., and their centers are each spaced about 0.250 in. from the center of bumper 52. While the disclosed bumper shape is the currently preferred shape, other shapes could be used if desired.

In accordance with the invention, protrusions 50 on second wall 20 are staggered from protrusions 50 on third wall 22 relative to dispensing direction 44. Such staggering provides a smooth movement of paper products 12 along dispensing direction 44 and out dispensing throat 32. Paper products 12, being supported alternately on one side or the other by the staggered protrusions 50, "walk" down housing 14 in dispensing direction 44 and out dispensing throat 32. Staggering protrusions 50 in dispensing direction 44 is important in embodiments where paper products 12 are moved in dispensing direction 44 due to the mounting or orientation of housing 14 by gravity. For example, if protrusions 50 were spaced opposite from each other on second wall 20 and third wall 22, paper products 12 might be entirely prevented from moving in dispensing direction and thus sit on top of a pair of protrusions 50. Also, paper products 12 might unevenly move in spurts past a pair of non-staggered protrusions 50 which could lead to misaligning of paper products and ultimately jamming of paper products within housing 14. Thus, staggering of protrusions 50 allows an orderly walking of paper products 12 along housing 14 in dispensing direction 44 where first one side of the paper products, and then the other, moves more steadily toward dispensing throat 32.

Preferably, container 10 includes a second group of protrusions 50 extending from first wall 18 and fifth wall 24 into interior area 28 to contact paper products 12. The second group of protrusions 50 is preferably disposed in a staging area 56 near dispensing throat 32 for spacing and slowing paper products 12 as they are moved in dispensing direction 44 through dispensing throat 32. Preferably, the second group of protrusions 50 includes at least one rib member 58 extending parallel to dispensing direction 44. Rib member 58 may include a number of teeth 60 extending from the rib member to contact paper products 12 and oppose the means for urging paper products 12 into dispensing direction 44. As shown in FIG. 2, two rib members 58 are preferably provided on fifth wall 24, and two similar rib members may also be provided on first wall 18. (See FIG. 7 for location of rib members 258 on first wall 218 of third embodiment 210). Teeth 60 preferably extend from 0.250 to 0.500 in. measured perpendicular to dispensing direction 44.

Housing 14 may be made of injection-molded plastic such as polyethylene or nylon. However, other suitable materials, such as other plastics or metals, may be provided for any or all of the parts of housing 14. Curved bumpers 52 and rib members 58 are preferably formed integral with housing 14. However, curved bumpers 52 and rib members 58 may be formed separately from housing 14 and attached later. Also, curved bumpers 52 and rib member 58 may be made of different material from housing 14 if desired. For example, curved bumpers 52 and/or rib members may be made of a more resilient material than the materials described above, such as an elastomer or rubber.

While curved bumpers 52 have been described as disposed on second and third walls 20 and 22, which are side walls in FIGS. 1 and 2 where housing 14 is mounted to wall 48, curved bumpers 52 could be disposed on any pair of opposite walls of housing 14. Also, although rib member or members 58 have been described as disposed on first and fifth wall 18 and 24, which are front and back walls in FIGS. 1 and 2, rib member or members 58 could be disposed on any wall or pair of opposite walls of housing. Preferably, curved bumpers 52 are disposed on one such pair of walls and rib member or members 58 are disposed on one or both of a different pair of side walls located 90° from those on which curved bumpers 52 are located.

Dispensing throat 32 may have many shapes within the scope of the present invention, as long as the throat provides easy access for a user and metered delivery of individual paper products.

Preferably, paper products 12 are interfolded or tab interfolded to provide metered feeding of individual napkins one at a time. However, the present invention does not require the use of interfolded paper products.

Figure 5:
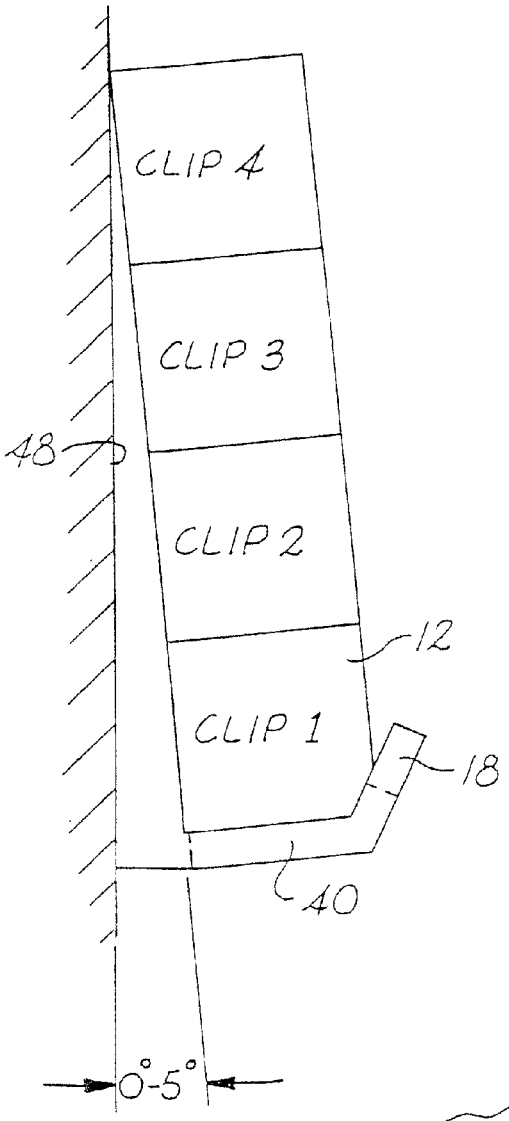
FIG. 5 is a diagrammatical view of a preferred mounting arrangement of the container shown in FIG. 2, mounted on a substantially vertical wall.

Housing 14 may hold multiple clips of paper products 14, as shown in FIG. 5., and may extend from 30 to as much as 48 in. from end to end. Preferably, fifth wall 24 is angled between 0–5° from the vertical to prevent paper products from falling out of housing 14 during refilling.

Figure 6:
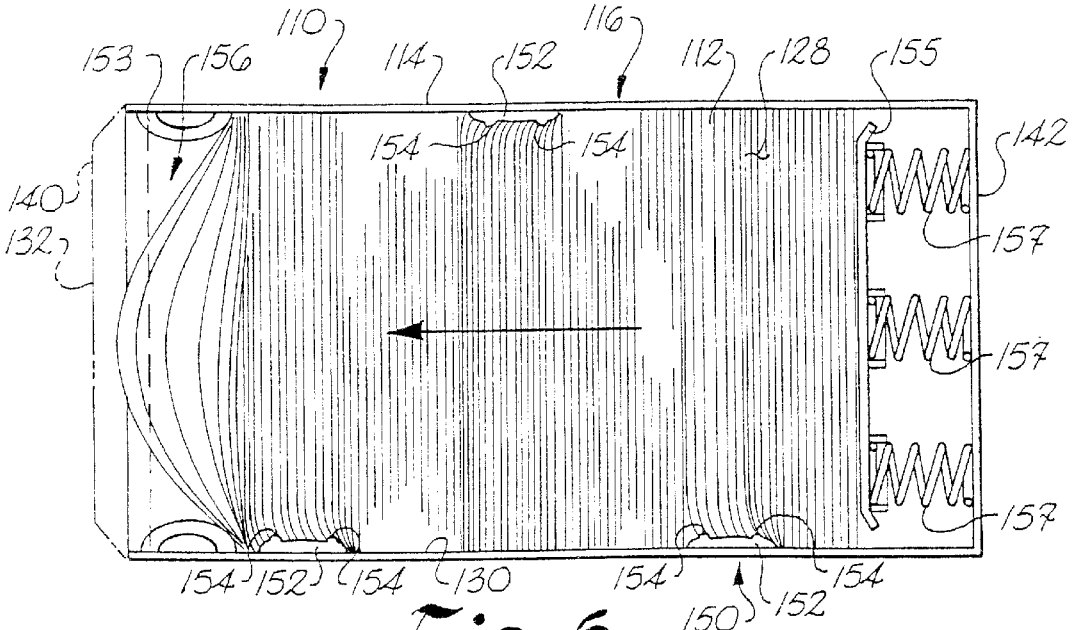
FIG. 6 is a sectional view of a container according to a second embodiment of the invention.

A second embodiment of the present invention is shown in FIG. 6, which discloses a container 110 similar to container 10 in most ways. Container 110 includes a housing 114 holding paper products 112 and including exterior walls 116. The paper products 112 are dispensed in a dispensing direction 144 through a dispensing throat 132. At least one protrusion 150 extends from interior surface 130 into interior area 128 to contact paper products 112.

Protrusions 150 include curved bumpers 152 including ridges 154 similar to those discussed above in connection with the first embodiment of the invention. Curved bumpers 152 are staggered in dispensing direction 144 as discussed above. A staging area 156 is provided adjacent dispensing throat 132 at first end 140 of housing 114. Staging area 156 includes additional curved bumpers 153 not staggered in dispensing direction 144. Bumpers 153 allow paper products 112 to bow at the middle toward dispensing throat 132 to make it easier for a user to remove a single paper product from dispensing throat 132.

In container 110, the means for urging paper products 112 from interior area 128 toward dispensing throat 132 in dispensing direction 144 is different from that of container 10. As shown in FIG. 6, a spring-loaded plate 155 is disposed within second end 142 of housing 114 along with at least one spring 157. When spring 157 is compressed by spring-loaded plate 155, spring 157 urges spring-loaded plate 155 in dispensing direction 144. Thus,when paper products 112 are placed in container 110 and spring-loaded plate is pushed to the right (as shown in FIG. 6) thereby compressing spring 157, spring-loaded plate 155 and spring 157 urge paper products 112 in dispensing direction 144 toward dispensing throat 132. Use of a spring-loaded plate and spring mechanism allows container 110 to be used in situations where dispensing direction 144 is substantially horizontal. Thus, container 110, which provides spring-loaded urging, can be used in locations where container 10, which provides gravity-assisted urging, could not. It should be understood that the staging bumpers 153 of container 110 could be replaced with rib members and teeth, similar to those used with container 10, and vice versa, if desired.

Figure 8B:
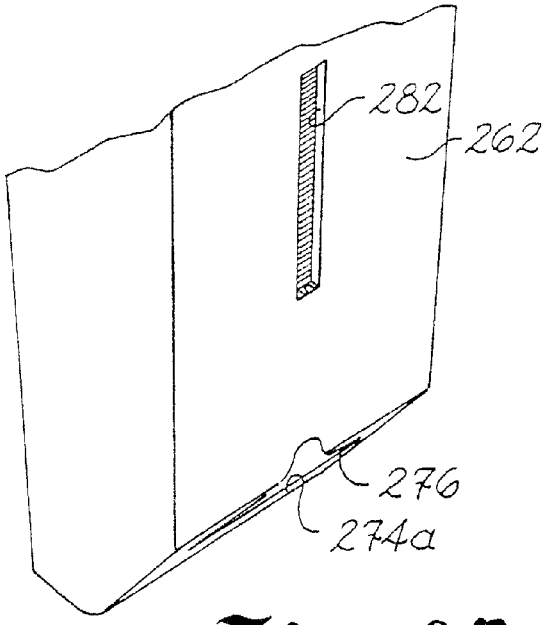
FIG. 8*b* is a partial perspective view showing an alternative embodiment of the cartridge of FIG. 8*a*.
Figure 4:
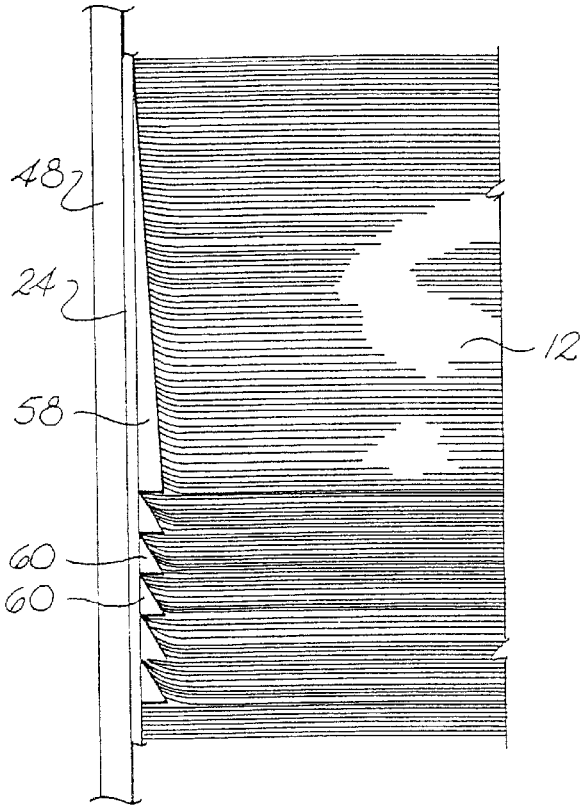
FIG. 4 is a partial sectional view of a portion of 4—4 in FIG. 2 showing a preferred embodiment of a toothed rib protrusion.
Figure 7:
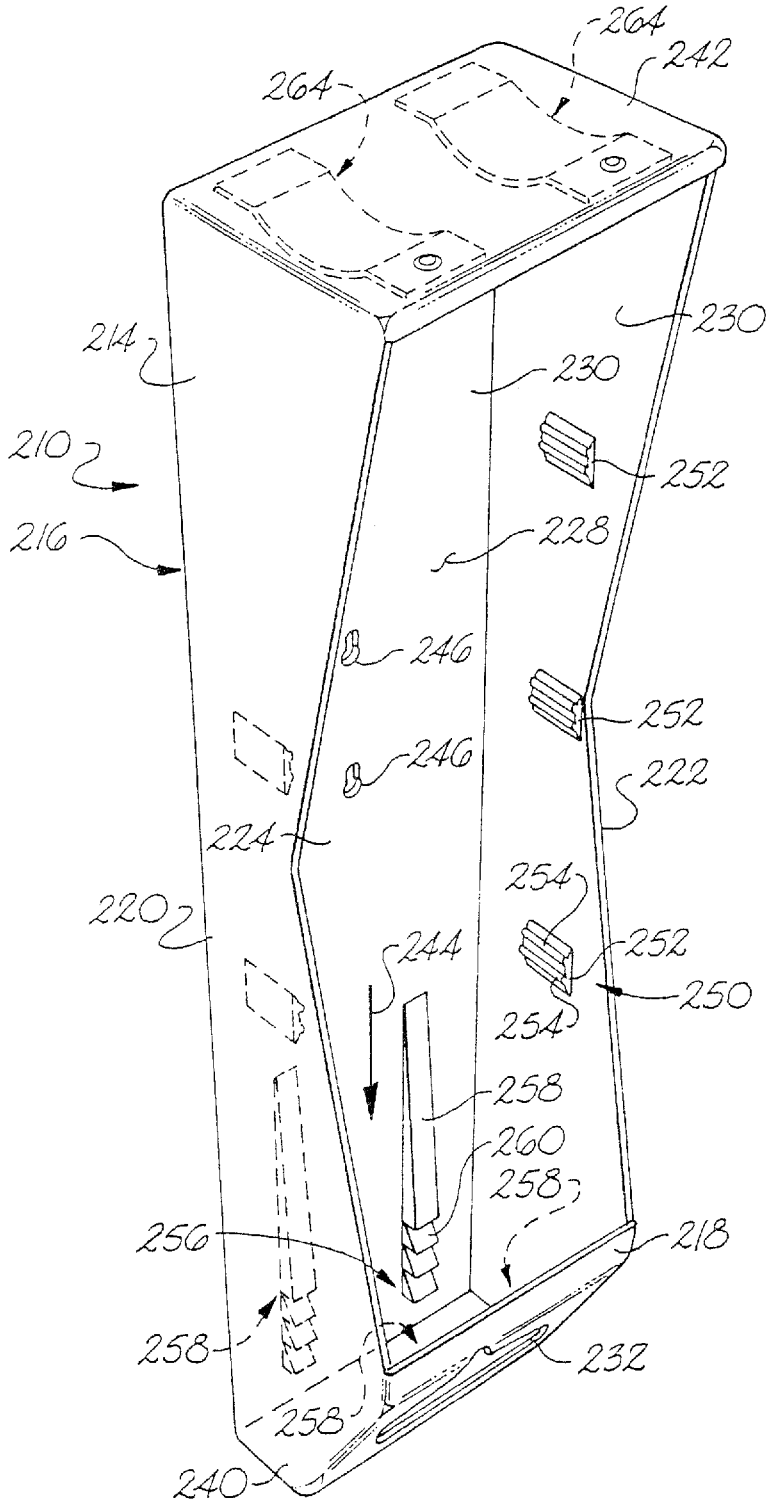
FIG. 7 is perspective view of a housing of a container according to a third embodiment of the present invention.

In accordance with the third embodiment of the present invention, a container 210 is provided for holding paper products 212 to be dispensed to a user. As shown in FIGS. 7–9, container 210 includes a housing 214 defined by exterior walls 216, including first wall 218, second wall 220, third wall 222, and fourth wall 224. Exterior walls 216 define an interior surface 230, within which is disposed an interior area 228. A dispensing throat 232 is provided through first wall 218. Housing 214 includes a first end 240 and a second end 242. Paper products 212 are dispensed in a dispensing direction 244 through dispensing throat 232. Housing 214 includes plurality of protrusions 250, including curved bumpers 252 having ridges 254 and rib members 258 having teeth 260 disposed in a staging area 256.

However, housing 214 need not include a fifth wall or door, as found in the first and second embodiments of the invention, although a door may be provided for security reasons. Further, housing 214 can also be. constructed with double walls, as in housing 14, for security reasons. Also, paper products 212 are not directly loaded into interior area 228, as in the first and second embodiments.

Figure 8A:
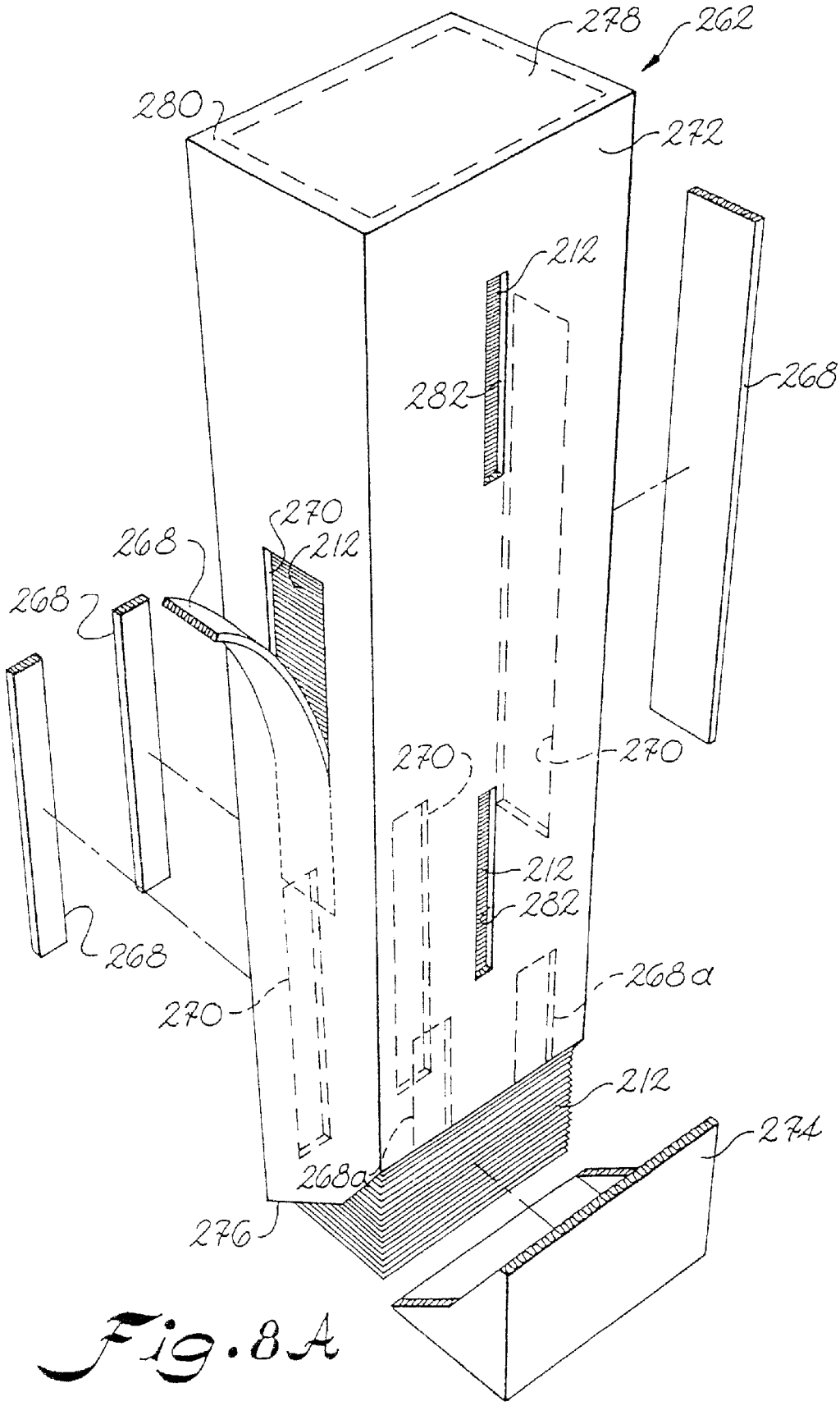
FIG. 8*a* is a perspective view of a cartridge according to the third embodiment of the present invention.
Figure 9:
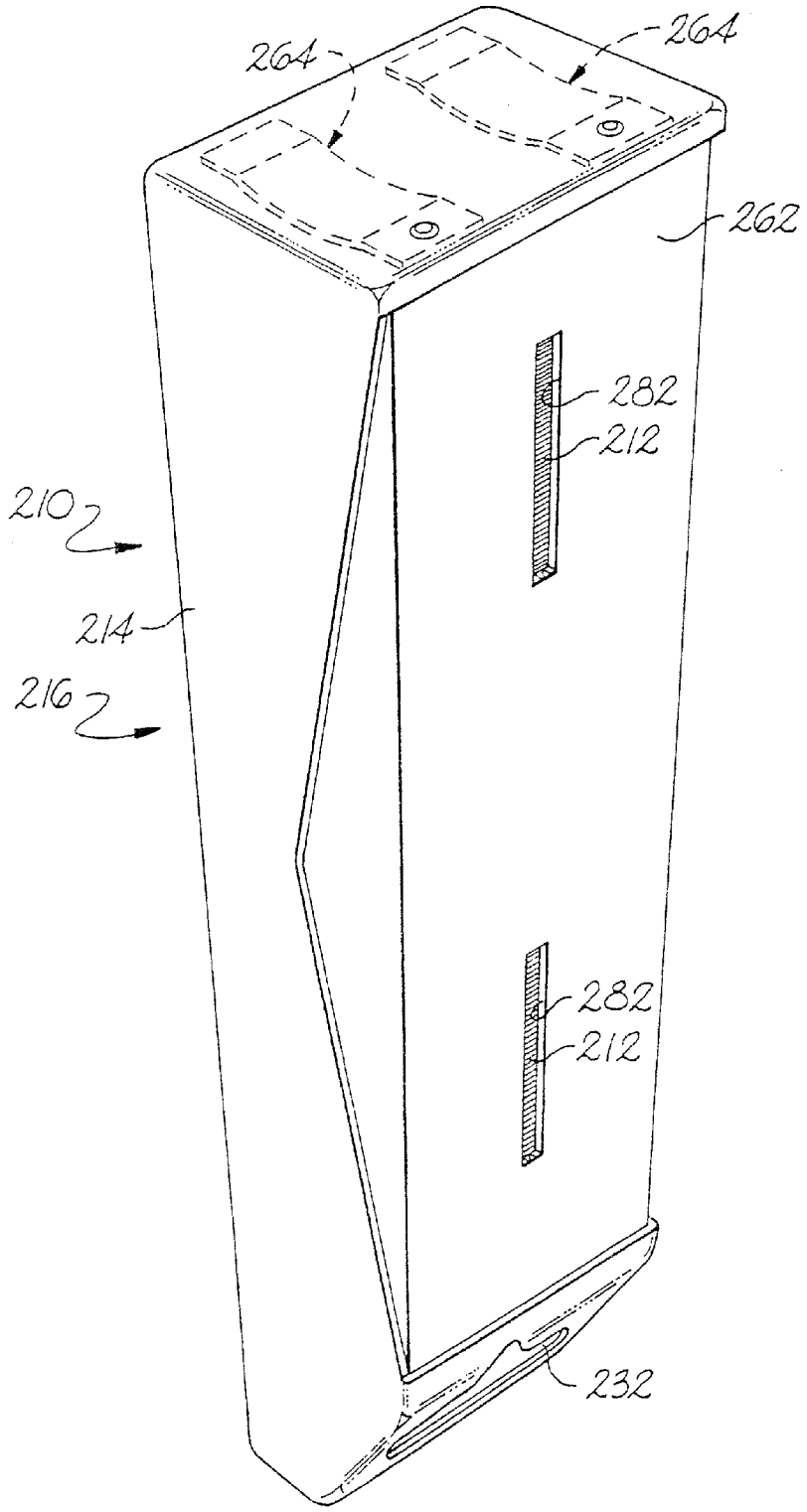
FIG. 9 is a perspective view of the third embodiment of the invention showing the cartridge placed in the housing.

As shown in FIG. 8*a*, a cartridge 262 is provided for insertion into interior area 228 of housing 214 for containing paper products 212 to be dispensed. As shown in FIG. 7, cartridge 262 is sized to fit snugly within interior area 228 of housing 214. If desired, leaf springs 264 may be provided attached to the inside of second end 242 of housing 214 to hold cartridge 262 in place. Any other suitable mechanism such as a tab or other interlock may be used to hold cartridge 262 in housing 214 within the scope of the invention.

Preferably, cartridge 262 includes a plurality of removable portions 268, the removal of which creates openings 270 through cartridge 262. As shown in FIG. 8*a*, cartridge 262 includes four removable portions 268 that create four openings 270 upon removal. Removable portions 268 are disposed in outside walls 272 of cartridge 262 so that, once removable portions 268 are removed, openings 270 encompass and receive protrusions 250 extending from interior surface 230 of housing 214. Thus, upon removal of removable portions 268 and placement of cartridge 262 in housing 214, curved bumpers 252 and rib members 258 contact the paper products 212 within cartridge and act just as the bumpers and rib members do in the first two embodiments of the invention.

Cartridge 262 may also include another removable portion 278 disposed at end 280 of cartridge 262. Removable portion 278 may be removed to receive a spring-loaded plate if cartridge 262 is to be used in a container such as that shown in FIG. 6 with a spring-loaded plate.

As shown in FIG. 8*a*, a removable portion 274 may be provided at end 276 of cartridge 262 to conform end 276 to first end 240 of housing 214 so that paper products 212 can be dispensed through dispensing throat 232. Alternately, end 276 of cartridge 262 may be formed as shown in FIG. 8*b*, so that removable portion 274 is not required and cartridge 262 fits into housing 214 without substantial modification of end 276. Thus, if desired, a smaller removable portion 274*a* (see FIG. 8*b*) may be provided corresponding to dispensing throat 232.

Removable portions 268, 278, and 274*a* may either be removed (or simply not formed) during manufacture of cartridge 262 or removed during installation of cartridge 262 in housing 214. If removable portions 268, 278, and 274*a* are to be removed as part of the manufacturing process, cartridge 262 should be shipped to the user wrapped, for example in a polyethylene bag, to preserve the sterility of the paper products in the cartridge. If removable portions 268, 278, and 274*a* are to be removed as part of the installation process, the edges of the removable portions should be weakened, scored, etc. for easy removal. Removable portion 274 should not be removed as part of the manufacturing process to ensure that paper products 12 remain properly loaded in cartridge 262.

As shown in FIG. 8*a*, optional removable portions 268*a* may be placed on front wall 273 of cartridge 262. Removable portions 268*a* may be used if optional protrusions 258 are used on first wall 218 of housing 214 (see FIG. 7). Such protrusions 258 may also be used on first wall 18 or fourth wall 26 of first embodiment housing 14, if desired.

Preferably, cartridge 262 includes at least one slot 282 extending through one of the cartridge walls 272. Slot 282 is visible from outside of housing 214 when cartridge 262 is mounted in interior area 228. A user can visually determine the amount of paper products 212 remaining within cartridge 262 by inspecting the amount of paper products visible through slot 282. As shown in FIG. 8*a*, two slots may be provided to provide a greater range of visual inspection. Any number or arrangement of slots is possible within the scope of the invention.

Cartridge 262 is preferably made of heavy paper or cardboard, but may be made of any other suitable material within the scope of the invention.

It will be apparent to those skilled in the art that various modifications and variations can be made in the present invention without departing from the scope and spirit of the invention. It is intended that the present invention include such modifications and variations as come within the scope of the appended claims and their equivalents.

I claim:

1. A cartridge for holding and dispensing a plurality of paper products in a substantially vertically downward dispensing direction, the cartridge being insertable into an interior area of a container having a housing defining a plurality of exterior walls and a dispensing throat at a bottom end of the housing, the interior area being disposed within an interior surface defined by the plurality of exterior walls, at least one protrusion extending from the interior surface into the interior area, the cartridge comprising:

a cartridge body including a plurality of cartridge side walls and a bottom end defining a dispensing opening configured to guide paper products substantially vertically downwardly in the dispensing direction through the dispensing throat; and at least one removable portion defined in at least one of the side walls of the cartridge body, removal of the removable portion creating an opening through the at least one of the cartridge side walls, the removable portion being located on the cartridge body so that when the cartridge is placed in the interior area of the housing the protrusion extends through the opening to contact edges of the plurality of paper products to oppose movement of the paper products in the dispensing direction.

2. The cartridge of claim 1, wherein the cartridge side walls include two opposing walls and at least two removable portions are provided, each removable portion being disposed on one of the cartridge opposing walls.

3. The cartridge of claimed 1, wherein the cartridge side walls include four cartridge side walls and at least four removable portions are provided, each removable portion being disposed on one of the cartridge side walls.

4. The cartridge of claim 1, wherein the cartridge defines at least one slot through one of the cartridge side walls, the slot being visible from outside the housing when the cartridge is in the interior area of the housing, an amount of paper products disposed within the cartridge being determinable by visually inspecting the amount of paper products through the slot.

5. A cartridge for holding and dispensing a plurality of paper products in a substantially vertically downward dispensing direction, the cartridge being insertable into an interior area of a container having a housing defining a plurality of exterior walls and a dispensing throat at a bottom end of the housing, the interior area being disposed within an interior surface defined by the plurality of exterior walls, at least one protrusion extending from the interior surface into the interior area, the cartridge comprising:

a cartridge body including a plurality of cartridge side walls and a bottom end defining a dispensing opening configured to guide paper products substantially vertically downwardly in the dispensing direction through the dispensing throat; and at least one opening defined in at least one of the side walls of the cartridge body and extending through the at least one of the cartridge side walls, the opening being located within the cartridge body so that when the cartridge is placed in the interior area of the housing the protrusion extends through the opening to contact edges of the plurality of paper products to oppose movement of the paper products in the dispensing direction.

6. The cartridge of claims 5 wherein the cartridge side walls include two opposing walls and at least two openings are provided, each opening being disposed on one of the cartridge opposing walls.

7. The cartridge of claim 5, wherein the cartridge side walls include four cartridge side walls and at least four openings are provided, each opening being disposed on one of the cartridge side walls.

8. The cartridge of claim 5, wherein the cartridge defines at least one slot through one of the cartridge side walls, the slot being visible from outside the housing when the cartridge is in the interior area of the housing, an amount of paper products disposed within the cartridge being determinable by visually inspecting the amount of paper products through the slot.

9. A housing insert for dispensing individual paper products, the insert for placement within a housing including a plurality of exterior walls defining an interior surface and an interior area within the interior surface, a dispensing throat extending though at least one of the exterior walls for permitting removal of paper products from the interior area, and at least one protrusion extending from the interior surface into the interior area of the housing, the housing insert comprising:

an insert configured and sized for insertion into the interior area of the housing for containing the plurality of paper products, the insert including an outside wall for substantially enclosing the paper products and a dispensing opening extending through the outside wall, the paper products being disposed within the insert for movement toward the dispensing opening and the dispensing throat in a substantially vertical dispensing direction, the paper products oriented within the housing so as to extend substantially perpendicular to the dispensing direction, the at least one protrusion extending so as to support the paper products against the force of gravity when the insert is placed in the interior area of the housing, the paper products being dispensable from the insert through the dispensing opening and the dispensing throat.

10. The housing insert of claim 9, wherein the at least one protrusion includes rib members extending parallel to the dispensing direction for supporting the paper products against the force of gravity.

11. The housing insert of claim 9, wherein the housing includes a staging area proximate the dispensing throat for spacing and slowing the paper products, the at least one protrusion being disposed in the staging area.

12. The housing insert of claim 9, wherein the housing includes a door openable for placement or removal of the insert from the housing.

13. The housing insert of claim 9, wherein a plurality of the protrusions is provided disposed in a staggered orientation on opposite walls of the housing.

14. The housing insert of claim 9, further defining at least one opening extending though the outside wall of the insert, each opening in the insert being disposed adjacent a respective one of the at least one protrusions so that each protrusion extends through a respective opening to contact the plurality of paper products.

15. The housing insert of claim 14, further including at least one removable portion in the outside wall of the insert, removal of one of the removable portions creating one of the openings in the outside wall of the insert.

16. The housing insert of claim 9, wherein the insert comprises a box.

17. The housing insert of claim 16, wherein the box is made of one of cardboard or paper.

18. The housing insert of claim 9, wherein the at least one protrusion includes curved bumpers.

19. The housing insert of claim 18, wherein the curved bumpers include a plurality of ridges extending across the curved bumpers perpendicular to the dispensing direction.

20. The housing insert of claim 9, wherein the housing includes means for retaining the insert within the housing.

21. The housing insert of claim 20, wherein the cartridge retaining means is selected from a spring, a tab, and interlocking or interacting housing and insert geometries.

* * * * *